US010680356B2

(12) United States Patent
Nobukuni et al.

(10) Patent No.: US 10,680,356 B2
(45) Date of Patent: Jun. 9, 2020

(54) COMBINATION TERMINAL

(71) Applicant: Sumitomo Wiring Systems, Ltd., Yokkaichi, Mie (JP)

(72) Inventors: Takashi Nobukuni, Mie (JP); Yuichi Goto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/371,171

(22) Filed: Apr. 1, 2019

(65) Prior Publication Data

US 2019/0305449 A1 Oct. 3, 2019

(30) Foreign Application Priority Data

Mar. 30, 2018 (JP) ..... 2018-067304

(51) Int. Cl.
*H01R 11/12* (2006.01)
*H01R 11/09* (2006.01)

(52) U.S. Cl.
CPC ..... *H01R 11/12* (2013.01); *H01R 11/09* (2013.01)

(58) Field of Classification Search
CPC ..... H01R 11/32; H01R 11/09; H01R 11/12; H01R 4/305
See application file for complete search history.

(56) References Cited

U.S. PATENT DOCUMENTS 5,934,923 A * 8/1999 Matsuoka ..... H01R 11/12 439/287
6,086,399 A * 7/2000 Matsunaga ..... H01R 4/305 439/287
6,530,795 B2 * 3/2003 Maeda ..... H01R 11/12 439/287
7,125,295 B2 * 10/2006 Zhao ..... H01R 11/12 439/883
8,747,139 B2 * 6/2014 Amano ..... H01R 11/12 439/287
9,300,093 B2 * 3/2016 Omori ..... H01R 4/64
10,096,912 B2 * 10/2018 Yamamoto ..... H01R 4/04
10,367,277 B2 * 7/2019 Lee ..... H01R 11/09
2004/0040734 A1 * 3/2004 Fujii ..... H01R 11/12 174/84 C
2005/0003703 A1 * 1/2005 Ono ..... H01R 11/26 439/516

FOREIGN PATENT DOCUMENTS

JP 2004-327355 11/2004

* cited by examiner

*Primary Examiner* — Briggitte R. Hammond
(74) *Attorney, Agent, or Firm* — Gerald E. Hespos; Michael J. Porco; Matthew T. Hespos

(57) ABSTRACT

A combination terminal (1) has a first terminal (10) overlapping a second terminal (110) in a plate thickness direction. The first terminal (10) includes a base (41) and two inclined walls (20) intersecting surfaces of the base (41) from both lateral ends of the base (41) and forming an insertion/accommodation space (C) having a trapezoidal shape. The second terminal (110) includes an inserting piece (132) that overlaps the base (41) when inserted into the insertion/accommodation space (C). A locking claw (132A) on the inserting piece (132) locks the base (41) by overlapping the inserting piece (132) on the base plate (41). An external force absorbing tapered portion (133) projects laterally from the inserting piece (132) and comes into surface contact with one of the inclined walls (42) with the locking portion (132A) locked to the base (41).

4 Claims, 8 Drawing Sheets

COMBINATION TERMINAL

BACKGROUND

Field of the Invention

This specification relates to a combination terminal usable as a ground terminal.

Related Art

Japanese Unexamined Patent Publication No. 2004-327355 discloses a combination terminal formed by assembling upper and lower terminal fittings. The upper terminal fitting includes front and rear flat plates. First and second engaging portions couple first and second ends of the flat plates of the upper terminal fitting to each other in a bridging manner and so that a mounting hole is enclosed by the first and second upper engaging portions. The lower terminal fitting includes a mounting hole between first and second lower engaging portions defined by rotating the first and second engaging portions of the upper terminal fitting by 180° about an axis in a front-rear direction. The first engaging portion of each terminal fitting is struck up to form a locking projection, and a locking hole penetrates the second engaging portion of each terminal fitting. The flat plates of the lower terminal fitting have front and rear lock projections that project into the locking holes.

With the terminal fittings assembled, the first and second engaging portions of one terminal fitting are inserted into the first and second engaging portions of the mating terminal fitting so that the both terminal fittings are overlapped while being vertically offset. Thus, separation of the terminal fittings in the thickness direction is restricted. Further, the locking projections and the locking holes are fit together, and the lock projection of the lower terminal fitting is engaged with the first engaging portion of the upper terminal fitting to restrict detachment of the first engaging portion from the second engaging portion and to hold the terminal fittings together.

An external force may be generated, for example during transportation of the combination terminal, and may bend the lower terminal fitting with the first and second engaging portions as a center. Thus, the first and second engaging portions may deform and the engaging portions of the upper terminal fittings may be lifted up. As a result, the locking projections exit from the locking holes and the terminal fittings separate.

SUMMARY

A combination terminal according to this specification is formed by overlapping a first terminal and a second terminal in a plate thickness direction. The first terminal includes a base with plates and two inclined walls extending in directions intersecting the plates of the base from both lateral ends of the base to form an insertion/accommodation space having a trapezoidal shape together with the base. The second terminal includes an inserting piece arrangeable to overlap on the base by being inserted into the insertion/accommodation space. A lock is provided on the inserting piece and is to be locked to the base by arranging the inserting piece to overlap the base. An external force absorbing tapered portion projects laterally from the inserting piece and can come into surface contact with one of the inclined walls with the locking portion locked to the base.

In the above configuration, if the second terminal does not include the external force absorbing tapered portion, the base may curve and deform together with the inclined walls and may separate from the inserting piece to be unlocked from the locking portion if an external force is applied to bend the inclined walls toward the insertion/accommodation space with the base as a center. In contrast, the second terminal includes the external force absorbing tapered portion that comes into surface contact with one of the inclined walls to absorb the external force with the inserting piece arranged to overlap the base and with the locking portion locked to the base. In this way, curved deformation of the base is suppressed and locking between the base and the inserting piece can be maintained.

Two of the external force absorbing tapered portions may be provided and may simultaneously achieve surface contact with both inclined walls. According to this configuration, the two external force absorbing tapered portions come into surface contact with the inclined walls to be sandwiched by the inclined walls. Thus, an external force applied to the inclined walls can be absorbed more reliably.

The first terminal may further include two first flat plates coupled to the inclined walls and extending laterally. The second terminal further includes two second flat plates that are arrangeable to overlap on the first flat plates in a direction opposite to an overlapping direction of the inserting piece on the base. The base has a locking hole communicating with the insertion/accommodation space, and the inserting piece is provided with a locking claw configured to project into the locking hole when the inserting piece is arranged to overlap on the base and is lockable to the locking hole in a front-rear direction. If the second terminal does not include the external force absorbing tapered portion, the locking claw is unlocked from the locking hole and the inserting piece is detached from the base in the front-rear direction if the base is separated from the inserting piece. In contrast, according to the above configuration, separation of the base from the inserting piece is suppressed by the external force absorbing tapered portion. Thus, the locked state of the locking claw and the locking hole in the front-rear direction can be maintained.

The second terminal may further include a coupling plate that couples the second flat plates to each other and arranged behind the inclined walls. The inserting piece has a tab shape extending forward from the coupling plate and a separating slit is formed between the external force absorbing tapered portion and the coupling plate. According to this configuration, the separating slit separates the external force absorbing tapered portion from the coupling plate. Thus, an external force can be absorbed without being affected by stress generated in the coupling plate.

The first terminal may include a wire connecting portion on one of the first flat plates and extending farther laterally outward than an outer side edge of one of the second flat plates and a rotation stop portion may be provided on the other of the first flat plates and extending farther laterally out than an outer side edge of the other of the second flat plates. According to this configuration, the wire connecting portion and the rotation stop are subject to an external force since the first terminal extends farther laterally out than the second terminal. However, the external force absorbing tapered portion comes into surface contact with the inclined wall to absorb the external force. Thus, even if an external force is applied to the wire connecting portion and the rotation stop portion, the detachment of the second terminal from the first terminal can be prevented.

Accordingly the combination terminal of this specification prevents detachment of one terminal fitting from the other.

DETAILED DESCRIPTION

Figure 1:
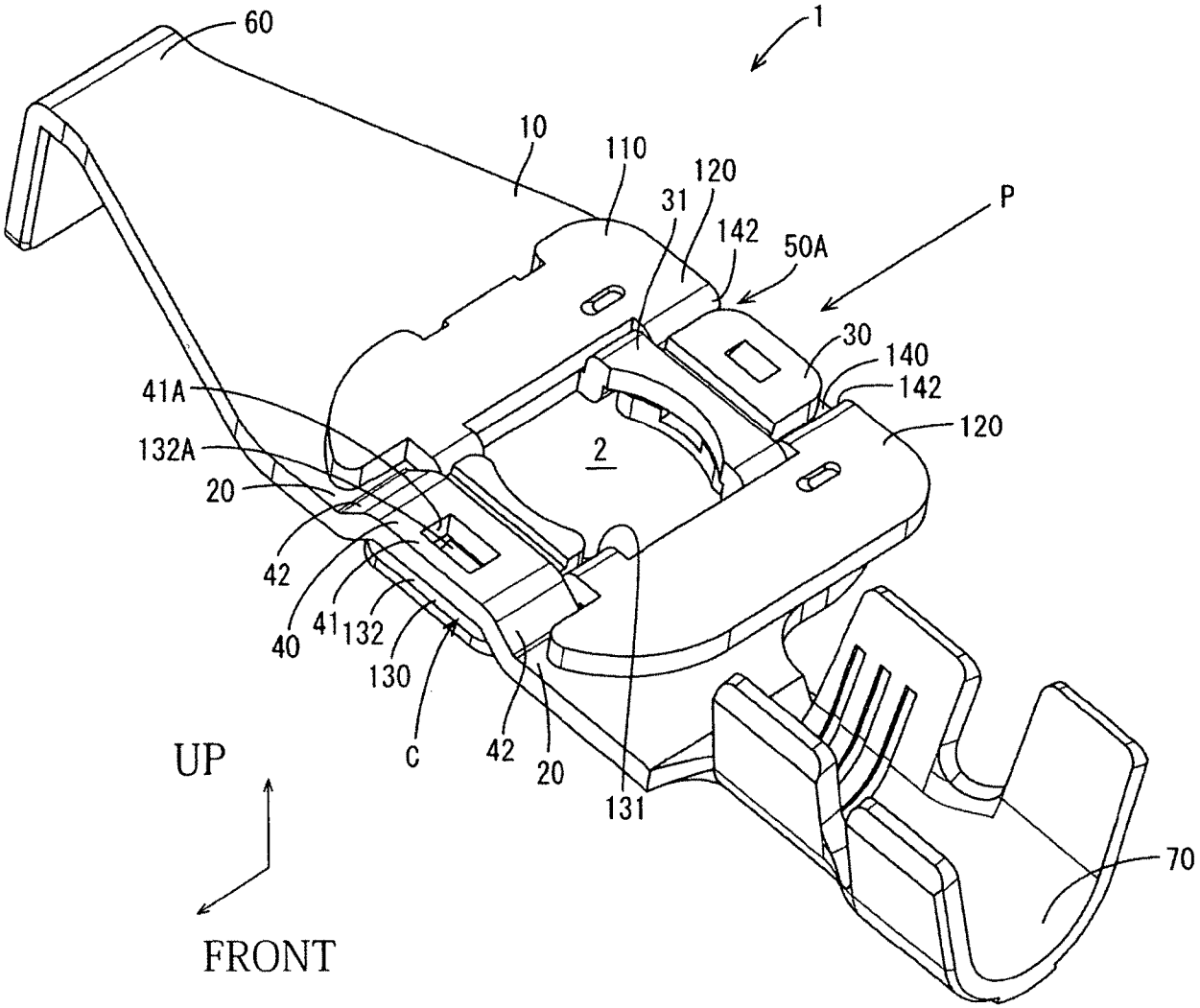
FIG. 1 is a perspective view of a combination terminal of an embodiment viewed from front.

An embodiment is described with reference to FIGS. 1 to 9. A combination terminal 1 of this embodiment is composed of a first terminal 10 and a second terminal 110 each formed to have a plate shape, and includes a bolt insertion hole 2 vertically penetrating in a center. The first terminal 10 is a ground terminal to be connected to a wire and grounded to a vehicle, and includes a wire connecting portion 70 to be connected to the wire and a rotation stop 60 to be mounted on an external device. The first terminal 10 can be used as a connection terminal for connecting devices in the vehicle to each other by turning another first terminal 10 upside down and assembling this first terminal 10. The second terminal 110 is a dummy terminal to be combined with the first terminal 10 to make an upper surface side of the terminal fitting flat when the first terminal 10 is used singly. Thus, the second terminal 110 includes neither the wire connecting portion 70 nor the rotation stop 60. In the following description, a plate thickness direction is a vertical direction and an upper side in FIG. 1 is referred to as an upper side in the combination terminal 1.

The first terminal 10 includes two first flat plates 20, a first inserting portion 30 and a first receiving portion 40. The second terminal 110 includes two second flat plates 120, a second receiving portion 140 and a second inserting portion 130. The second terminal 110 is locked to the first terminal 10 in the plate thickness direction, as shown in FIG. 1, by overlapping the second flat plates 120 on the upper surfaces of the first flat plates 20 shown in FIG. 1 while the second inserting portion 130 and the second receiving portion 140 are inserted respectively below the first receiving portion 40 and the first inserting portion 30 in a direction indicated by an arrow P in FIG. 1. In the following description, ends with the first receiving portion 40 and the second inserting portion 130 are referred to as a front.

Figure 6:
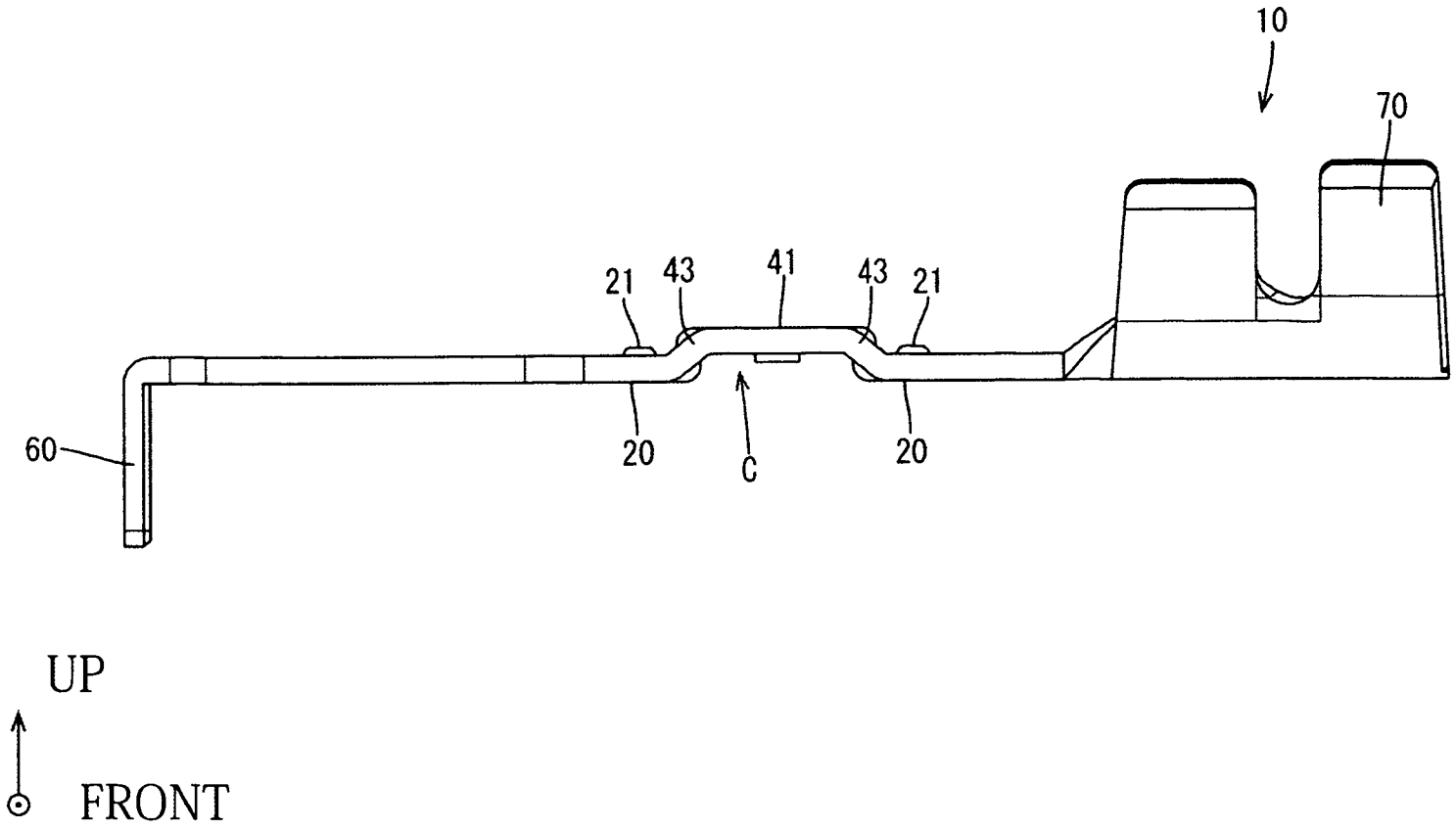
FIG. 6 is a front view of the first terminal.
Figure 8:
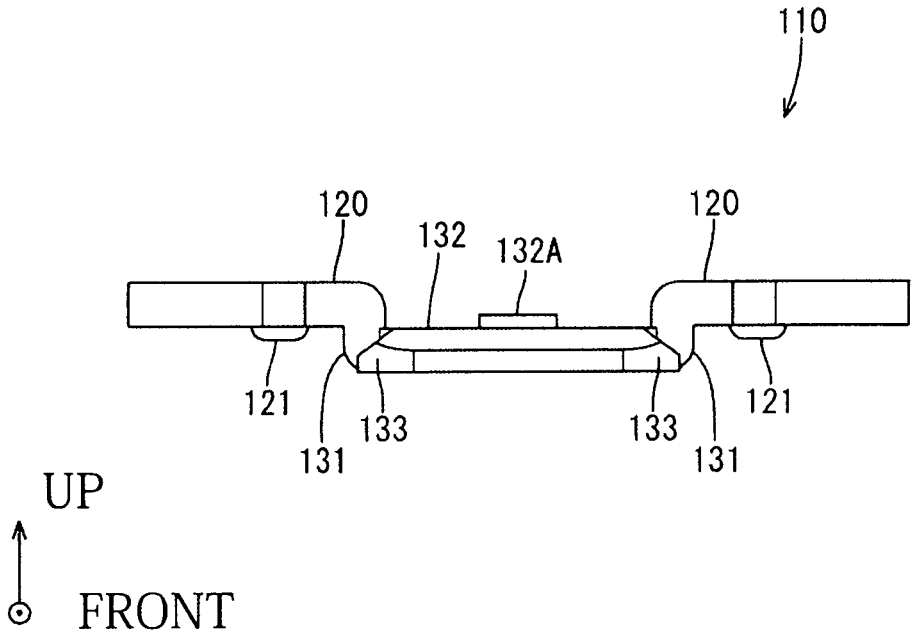
FIG. 8 is a front view of the second terminal.

The first flat plates 20 of the first terminal 10 are flat and coplanar. As shown in FIG. 6, first deviation preventing projections 21 projects up on a front part of each first flat plate 20. The second flat plates 120 of the second terminal 110 also are flat and coplanar. As shown in FIG. 8, a second deviation preventing projection 121 projects down on a rear part of each second flat plate 120. The first and second deviation preventing projections 21, 121 respectively contact the second and first flat plates 120, 20 to restrict deviations of the first and second terminals 10, 110 in a horizontal direction.

Figure 2:
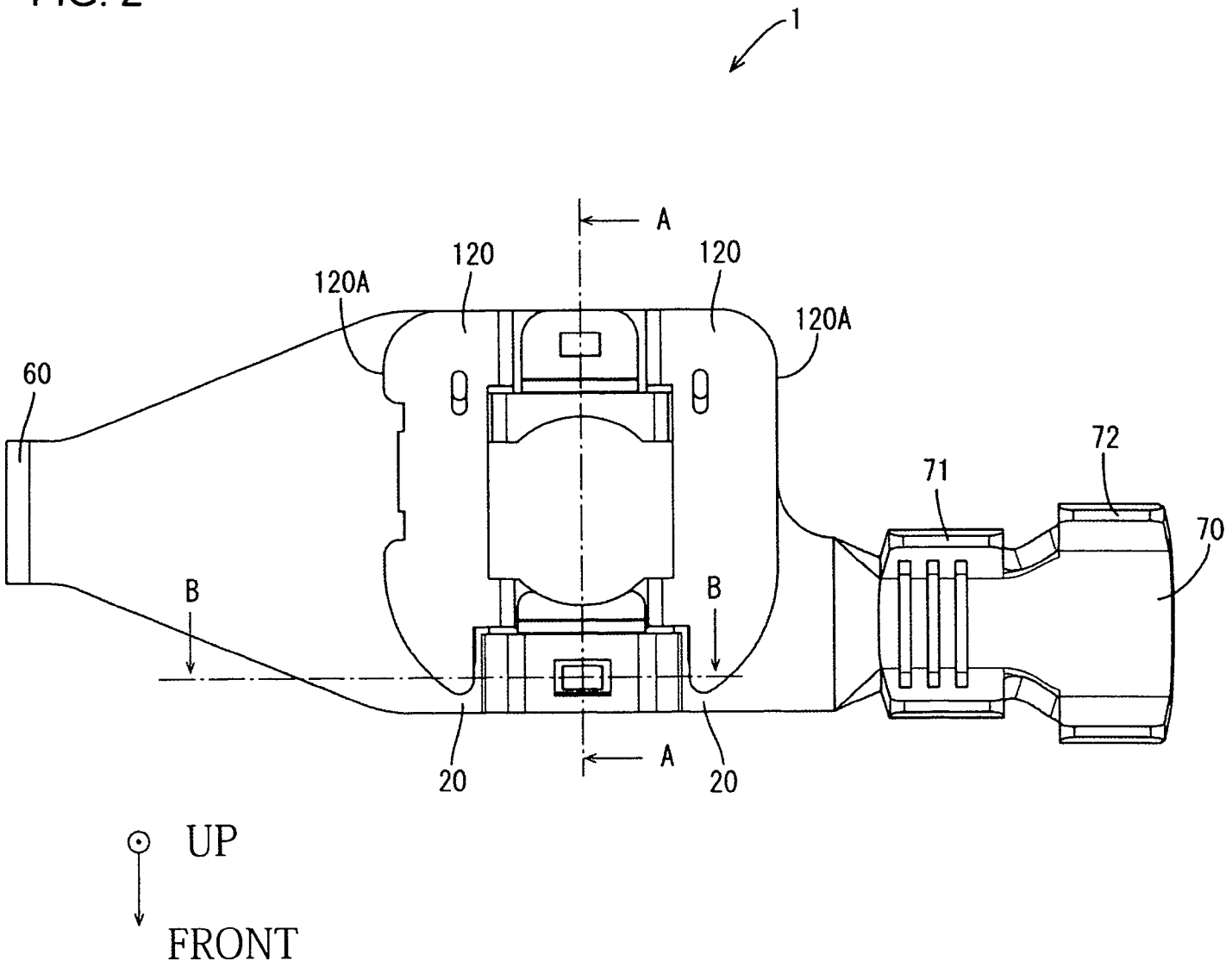
FIG. 2 is a top view of the combination terminal.

The first flat plate 20 shown on a left side in FIG. 2 is provided integrally with the rotation stop 60. The rotation stop 60 extends farther left than a left side edge 120A of the second flat plate 120 from the first flat plate 20 and an extending end part thereof is bent down. The first flat plate 20 shown on a right side in FIG. 2 is integral with the wire connecting portion 70. The wire connecting portion 70 extends farther right than a right edge 120A of the second flat plate 120 from a front of the first flat plate 120, and includes a wire barrel 71 to be crimped to a core of the wire and an insulation barrel 72 to be crimped to a coating part of the wire on an extending end part thereof.

Figure 3:
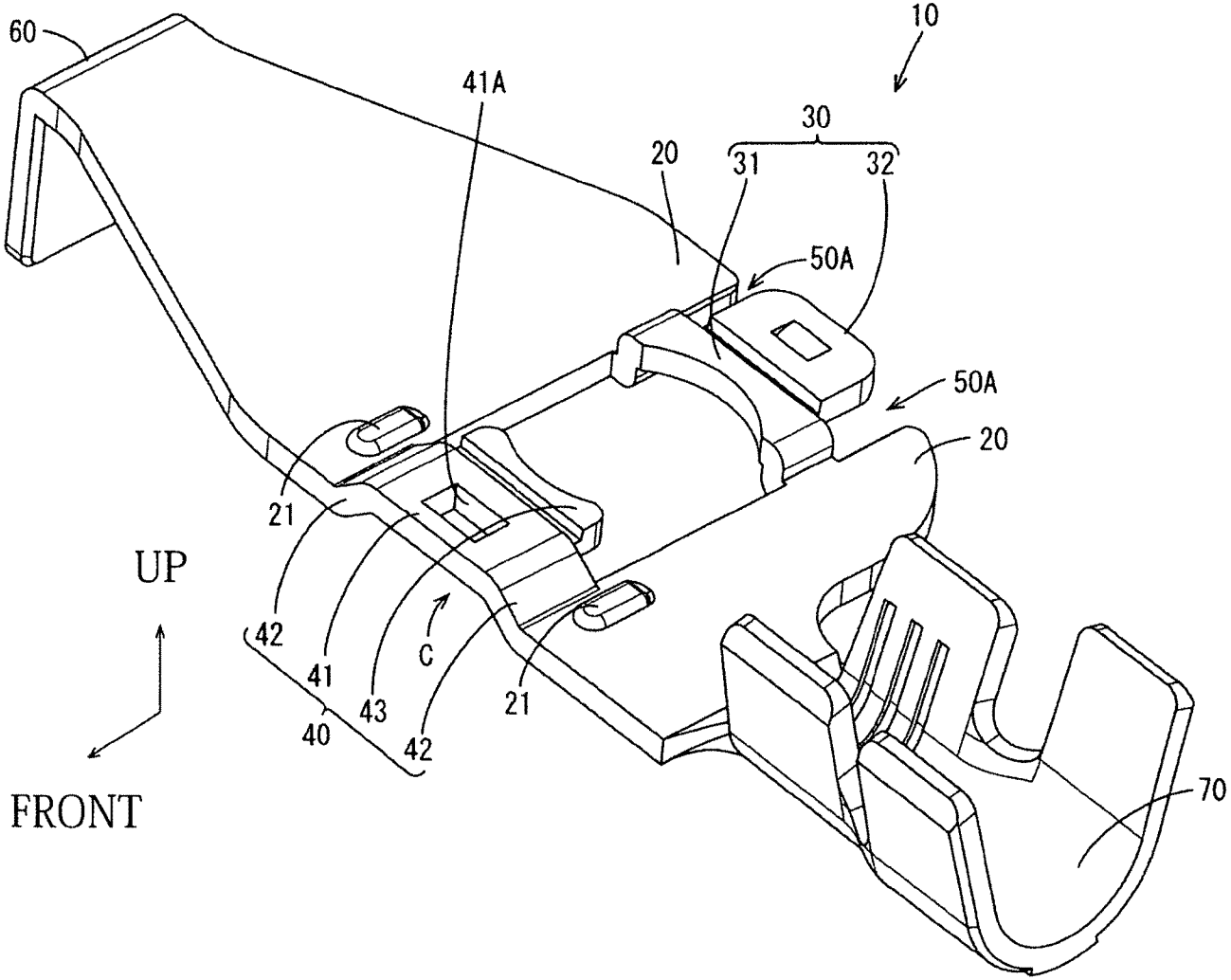
FIG. 3 is a perspective view of a first terminal viewed from front.
Figure 4:
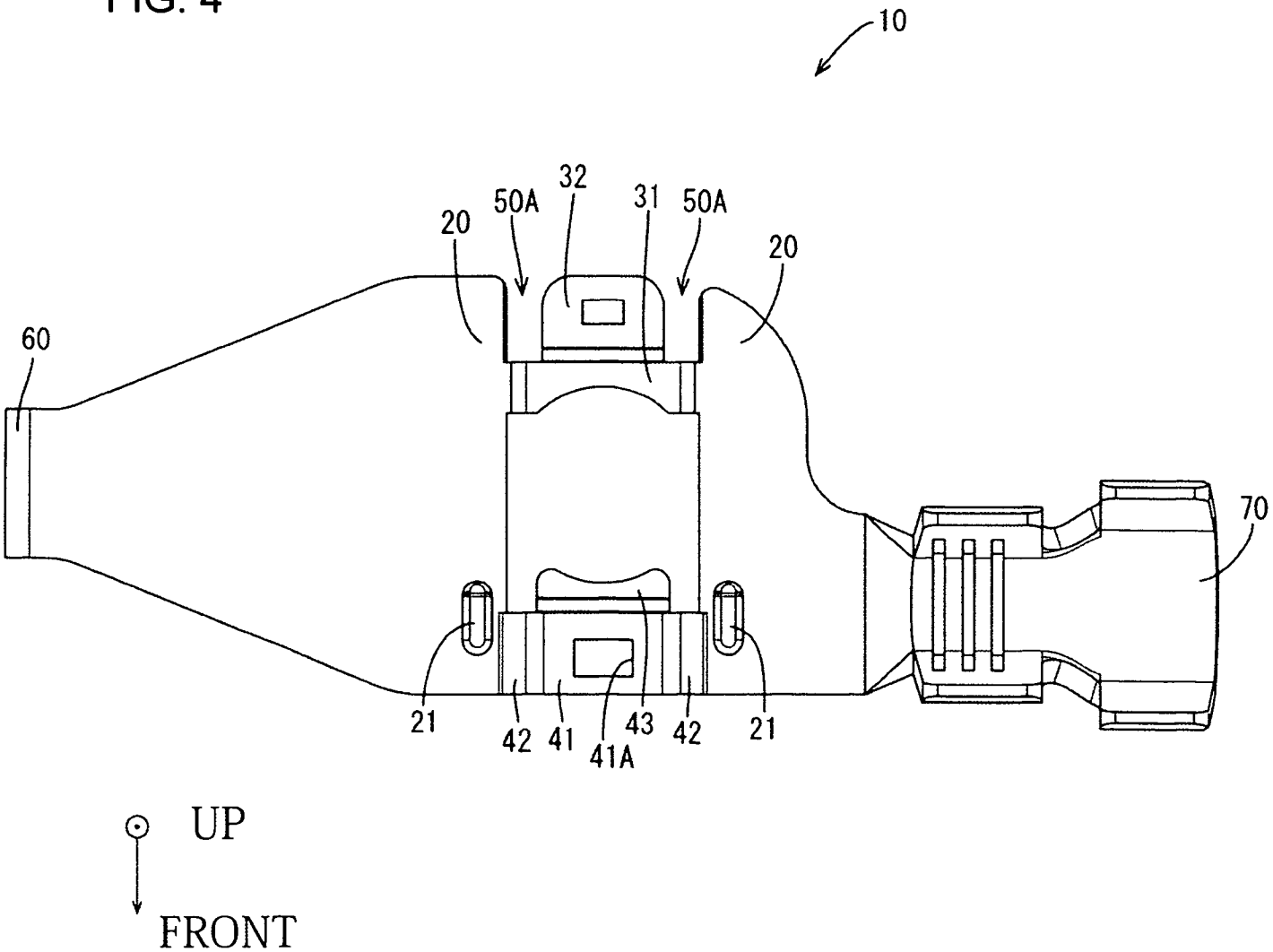
FIG. 4 is a top view of the first terminal.
Figure 5:
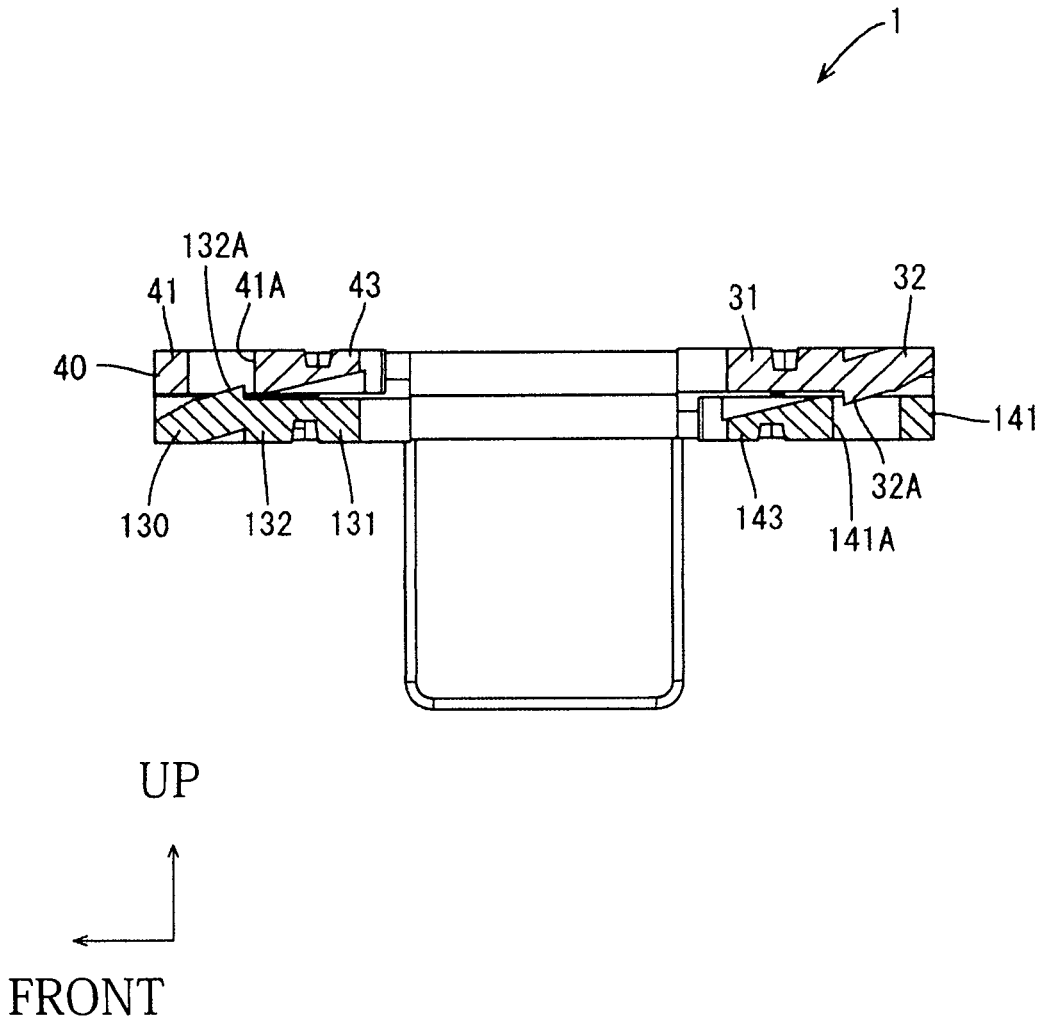
FIG. 5 is a section along A-A of FIG. 2.

The first inserting portion 30 of the first terminal 10 is composed of a rear coupling plate 31 in the form of a strip long in a lateral direction and a rear inserting piece 32 having a tab shape extending rearward from the rear coupling plate 31, as shown in FIGS. 3 and 4. Both lateral ends of the rear coupling plate 31 extend vertically down from each first flat plate 20 and the extending ends thereof are coupled to inner side edges of the first flat plates 20. In this way, a central part of the rear coupling plate 31 and the rear inserting piece 32 are elevated by about one plate thickness from the first flat plate 20 to form steps. A rear insertion slit 50A long and narrow in the front-rear direction is formed between each rear inserting piece 32 and each first flat plate 20. As shown in FIG. 5, a rear locking claw 32A projects down in a substantially in a central part of the rear inserting piece 32 in the front-rear direction and lateral direction.

Figure 7:
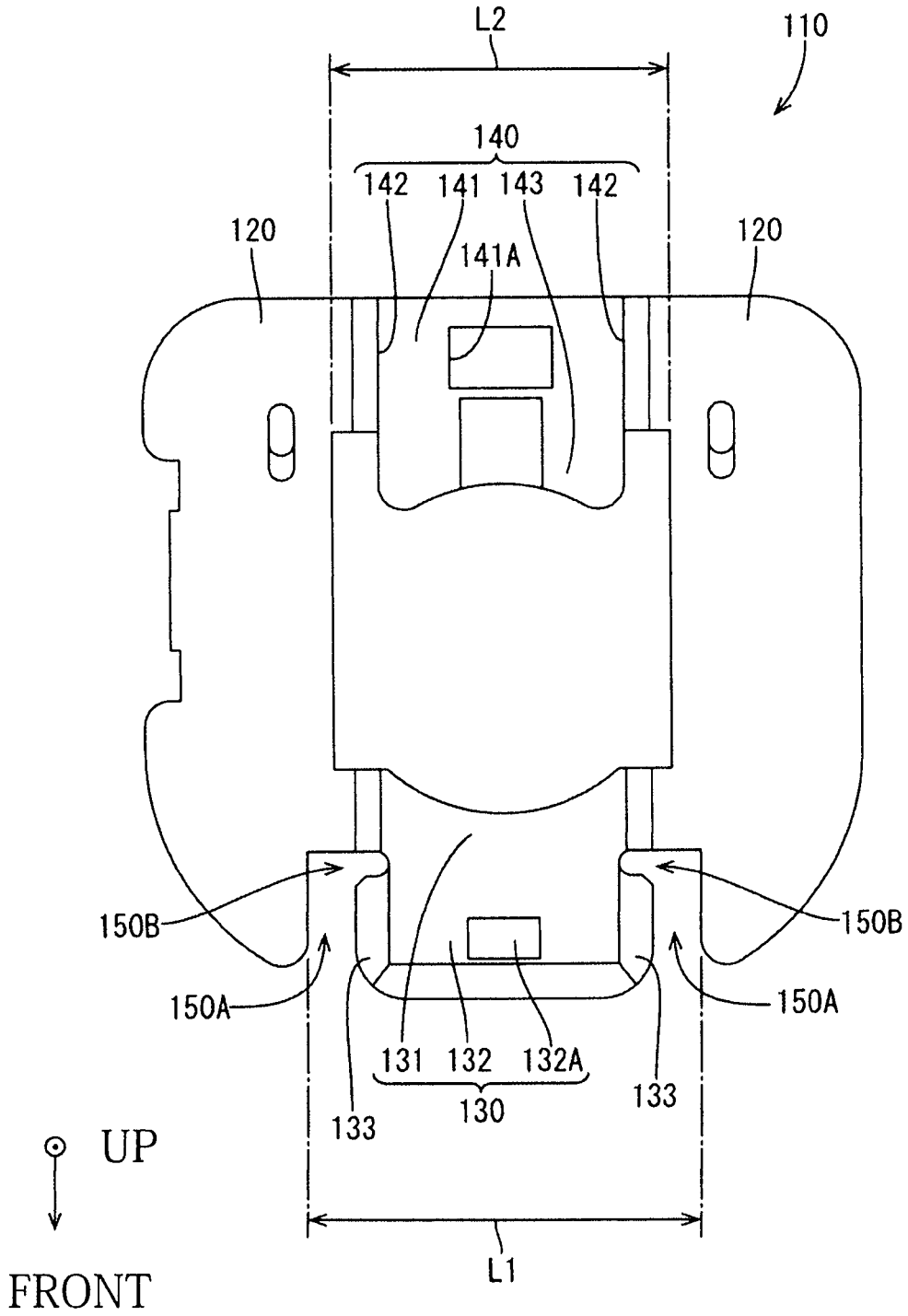
FIG. 7 is a top view of a second terminal.

The second receiving portion 140 of the second terminal 110 includes a wide flat rear base plate 141 that couples the second flat plates 120 to each other, two vertical walls 142 and a rear hole piece 143, as shown in FIG. 7. The rear hole piece 143 is a wide strip with an arcuate front edge and is coupled to the front end of the rear base plate 141. The two vertical walls 142 extend vertically up from both lateral ends of the rear base plate 141, and the extending ends thereof are coupled to inner side edges of the second flat plates 120. A rear locking hole 141A vertically penetrates the rear base plate 141 at a substantially central position in the front-rear direction as shown in FIG. 5.

Lateral displacement of the second receiving portion 140 with respect to the first inserting portion 30 is restricted by inserting the vertical walls 142 into the rear insertion slits 50A, inserting the rear inserting piece 32 into a rectangular space formed by the rear base plate 141 and the vertical walls 142, and laterally surrounding the rear hole piece 143 by the rear coupling plate 31. Further, a forward displacement of the second receiving portion 140 is restricted by arranging the lateral ends of the rear coupling plate 31 to face the two vertical walls 142 from behind, as shown in FIG. 1, and a rearward relative displacement thereof with respect to the first inserting portion 30 is restricted by locking the edge of the rear locking hole 141A to the rear locking claw 32A, as shown in FIG. 5.

The first receiving portion 40 of the first terminal 10 includes a wide base plate 41 coupling the respective first flat plates to each other, two inclined walls 42 and a hole piece 43, as shown in FIGS. 3 and 4. The hole piece 43 is a wide strip plate with an arcuate rear edge and is coupled to the rear end of the base plate 41. The two inclined walls 42 extend obliquely down to be separated from each other with both lateral ends of the base plate 41, as base ends, and the extending ends thereof are coupled to the inner side edges of the first flat plates 20. In this way, the base plate 41 and the inclined walls 42 form an insertion/accommodation space C having a trapezoidal cross-section, as shown in FIG. 6. A locking hole 41A vertically penetrates a substantially central part of the base plate 41 in the front-rear direction, as shown in FIG. 5.

The second inserting portion 130 of the second terminal 110 is composed of a wide coupling plate 131 and an inserting piece 132 having a tab shape extending forward from the coupling plate 131, as shown in FIG. 7. Both lateral ends of the coupling plate 131 extend vertically up from the second flat plates 120, as shown in FIG. 8, and the extending ends thereof are coupled to the inner side edges of the second flat plates 120. In this way, a central part of the coupling plate 131 and the inserting piece 132 are lowered by about one plate thickness from the second flat plates 120 to form steps. A locking claw 132A projects up from a central part of the inserting piece 132 in the front-rear direction and lateral direction.

As shown in FIG. 1, lateral displacement of the second inserting portion 130 with respect to the first receiving portion 40 is restricted by: inserting the inserting piece 132 into the insertion/accommodation space C formed by the base plate 41 and the inclined walls 42; laterally surrounding the inserting piece 132 by the inclined walls 42; and laterally surrounding the hole piece 43 by the coupling plate 131. Forward displacement of the second inserting portion 130 with respect to the first receiving portion 40 is restricted by arranging the coupling plate 131 to face the two inclined walls 42 from behind, as shown in FIG. 1 and a rearward displacement thereof relative to the first inserting portion 30 is restricted by locking the locking claw 132A to the locking hole 41A, as shown in FIG. 5.

The wire connecting portion 70 and the rotation stop 60 of the first terminal 10 extend laterally farther out than the second terminal 110 as described above. If the first terminal 10 and the second terminal 110 are transported while assembled into the combination terminal 1, the wire connecting portion 70 and the rotation stop 60 are subject to an external force, such as by being entangled with another combination terminal 1. This force could cause a front side of the first terminal 10 having the wire connecting portion 70 coupled thereto to be bent toward a side where the insertion/accommodation space C is formed, with the base plate 41 as a center. Accordingly, the base plate 41 may curve and deform up to be lifted up from the inserting piece 132, and locking between the locking claw 132A and the locking hole 41A may be released and the second terminal 110 may slip rearward from the first terminal 10.

Figure 9:
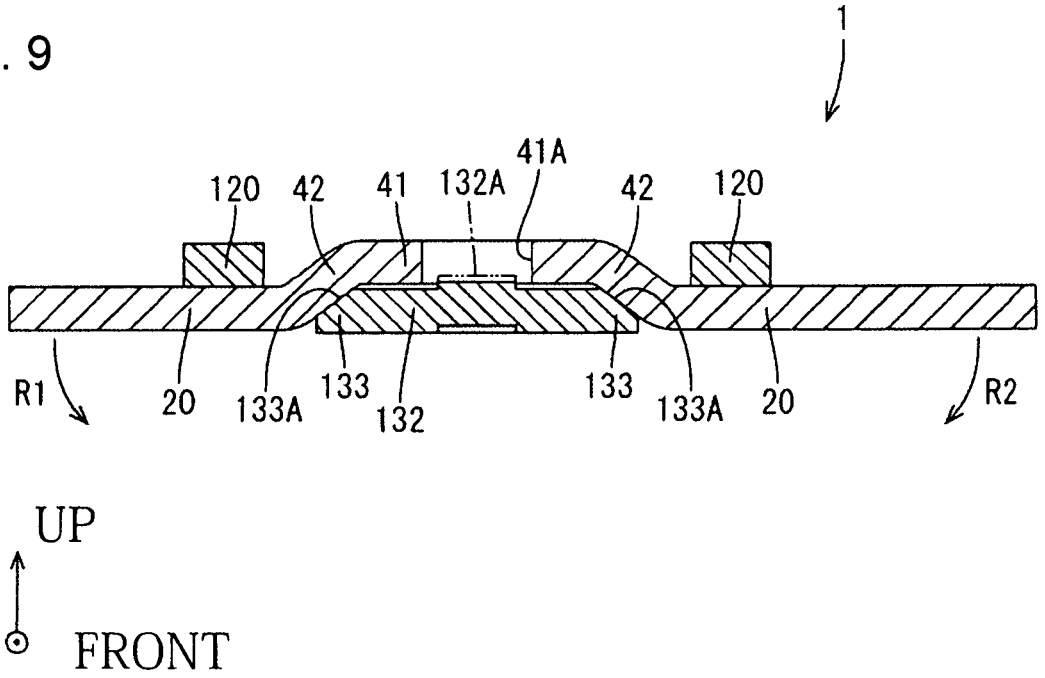
FIG. 9 is a section along B-B of FIG. 2.

Accordingly, the second terminal 110 of this embodiment is provided with two external force absorbing tapered portions 133 for absorbing an external force applied to the first terminal 10 and making the base plate 41 unaffected by the external force. As shown in FIG. 9, the external force absorbing tapered portions 133 laterally project from both lateral ends of the inserting piece 132 and are formed into a tapered shape whose upper surface side is inclined down. In this way, the inserting piece 132 and the external force absorbing tapered portions 133 form a trapezoidal cross-section corresponding to the trapezoidal cross-sectional shape of the insertion/accommodation space C.

Insertion slits 150A extend in the front-rear direction between the external force absorbing tapered portions 133 and the second flat plates 120, as shown in FIG. 7. A dimension L1 between an outer side edge of one insertion slit 150A and an outer side edge of the other insertion slit 150A is larger than an opening dimension of the bolt insertion hole 2.

The external force absorbing tapered portions 133 project farther forward than the lateral ends of the inserting piece 132 except at base ends (i.e. parts coupled to the coupling plate 131). Thus, vertically penetrating separating slits 150B are formed between the external force absorbing tapered portions 133 and the coupling plate 131. The separating slits 150B communicate with the insertion slits 150A between the external force absorbing tapered portions 133 and the second flat plates 120. In this way, the external force absorbing tapered portions 133 are separated from the coupling plate 131 and the second flat plates 120 and are unaffected by stresses generated in the coupling plate 131 and the second flat plates 120.

With the first terminal 10 and the second terminal 110 assembled into the combination terminal 1, the external force absorbing tapered portions 133 are accommodated in the insertion/accommodation space C while being laterally surrounded, together with the inserting piece 132, by the inclined walls 42, as shown in FIG. 1. If an external force is applied to the wire connecting portion 70, and the rotation stop 60 and the first flat plates 20 are going to be bent in directions indicated by arrows R1 and R2 in FIG. 9 with the base plate 41 as a center upon receiving this external force, the inclined walls 42 come into surface contact with tapered surfaces 133A of the external force absorbing tapered portions 133. In this way, the external force is absorbed by the external force absorbing tapered portions 133 and curved deformation of the inclined walls 42 and the base plate 41 is suppressed. Thus, the base plate 41 maintains relative locking of the locking hole 41A and the locking claw 132A without being lifted up from the inserting piece 132.

According to this embodiment, the combination terminal 1 is formed by overlapping the first and second terminals 10, 110 in the plate thickness direction. The first terminal 10 includes the base plate 41 and the two inclined walls 42 extending angularly from both lateral ends of the base plate 41 to form the insertion/accommodation space C having a trapezoidal shape. The second terminal 110 includes the inserting piece 132 arrangeable to overlap the base plate 41 by being inserted into the insertion/accommodation space C. The locking claw 132A of the inserting piece 132 is locked to the base plate 41 by overlapping the inserting piece 132 on the base plate 41. The external force absorbing tapered portion 133 has a tapered shape and laterally projects from the inserting piece 132 for coming into surface contact with one of the inclined walls 42 with the locking claw 132A locked to the base plate 41.

In the above configuration, if the second terminal 110 does not include the external force absorbing tapered portion 133, the base plate 41 may deform together with the inclined walls 42 and may separate from the inserting piece 132 to be unlocked from the locking portion 132A in response to an external force applied to bend the inclined walls 42 toward the insertion/accommodation space C with the base plate 41 as a center while the locking claw 132A is locked to the base plate 41. In contrast, according to the above configuration, the second terminal 110 includes the external force absorbing tapered portion 133 and the external force absorbing tapered portion 133 comes into surface contact with one of the inclined walls 42 to absorb the external force with the inserting piece 132 arranged to overlap on the base plate 41 and the locking claw 132A locked to the base plate 41. In this way, the base plate 41 will not deform and locking between the base plate 41 and the inserting piece 132 can be maintained.

Two of the external force absorbing tapered portions 133 are provided and can simultaneously come into surface contact with the inclined walls 42. According to this configuration, the external force absorbing tapered portions 133 come into surface contact with the inclined walls 42 to be sandwiched by the inclined walls 42. Thus, the external force applied to the inclined walls 42 can be absorbed more reliably.

The first terminal 10 further includes the two first flat plates 20 coupled to the two inclined walls 42 and laterally extending. The second terminal 110 further includes the two second flat plates 120 that overlap on the first flat plates 20 in a direction opposite to an overlapping direction of the inserting piece 132 on the base plate 41. The base plate 41 has the locking hole 41A communicating with the insertion/accommodation space C, and the inserting piece 132 has the locking claw 132A that projects into the locking hole 41A when the inserting piece 132 overlaps on the base plate 41 and that locks to the locking hole 41A in the front-rear direction.

If the second terminal 110 does not include the external force absorbing tapered portions 133, the locking claw 132A is unlocked from the locking hole 41A and the inserting piece 132 is detached from the base plate 41 in the front-rear direction. In contrast, according to the above configuration, the external force absorbing tapered portions 133 prevent separation of the base plate 41 from the inserting piece 132 so that the locked state of the locking claw 132A and the locking hole 41A in the front-rear direction is maintained.

The second terminal 110 further includes the coupling plate 131 behind the inclined walls 42 and coupling the second flat plates 120 to each other. The inserting piece 132 has a tab shape extending forward from the coupling plate 131 and the separating slits 150B are formed between the external force absorbing tapered portions 133 and the coupling plate 131. According to this configuration, the external force absorbing tapered portions 133 are separated from the coupling plate 131 by the separating slits 150B. Thus, an external force can be absorbed without being affected by stress generated in the coupling plate 131.

The first terminal 10 includes the wire connecting portion 70 on one of the first flat plates 20 and extending laterally farther out than the outer side edge 120A of one of the second flat plates 120. Additionally, the rotation stop 60 on the other of the first flat plates 20 extend laterally farther out than the outer side edge 120A of the other of the second flat plates 120. According to this configuration, the wire connecting portion 70 and the rotation stop 60 are subject to an external force since the first terminal 10 extends laterally farther out than the second terminal 110, but the external force absorbing tapered portions 133 come into surface contact with the inclined walls 42 to absorb the external force. Thus, even if an external force is applied to the wire connecting portion 70 and the rotation stop 60, the second terminal 110 will not detach from the first terminal 10 as described above.

The invention is not limited to the above described and illustrated embodiment and can be, for example, embodied as follows.

Although the external force absorbing tapered portions 133 are provided on both lateral ends of the inserting piece 132 in the above embodiment, an external force absorbing tapered portion may be provided on only one lateral end of an inserting piece. Alternatively, a second receiving portion may be provided with inclined walls instead of vertical walls and an external force absorbing tapered portion(s) may be provided on both or one of lateral ends of a rear inserting piece of a first inserting portion.

Although the first terminal 10 includes the first flat plates 20 and the second terminal 110 includes the second flat plates 120 as vertical locking means for the first terminal 10 and the second terminal 110, the vertical locking is not limited to this. For example, the tips of a rear locking claw and a locking claw may be formed into hooks, and a first terminal and a second terminal may be locked to each other in the vertical direction by hooking these tips to edges of a rear locking hole and a locking hole.

Although the separating slits 150B are formed between the external force absorbing tapered portions 133 and the coupling plate 131 in the above embodiment, the separating slits may not be provided, for example, if stress of a coupling plate affects external force absorbing tapered portions only to a negligible extent.

Although only the first terminal 10 includes the wire connecting portion 70 and the rotation stop portion 60 and is laterally longer than the second terminal 110 in the above embodiment, the configurations of a first terminal and a second terminal are not limited to this. For example, a first terminal may include only a wire connecting portion without including a rotation stop or a second terminal may include one or both of a wire connecting portion and a rotation stop portion.

LIST OF REFERENCE SIGNS

1: combination terminal
10: first terminal
20: first flat plate
40: first receiving portion
41: base plate
41A: locking hole
42: inclined wall
C: insertion/accommodation space
43: hole piece
60: rotation stop
70: wire connecting portion
110: second terminal
120: second flat plate
120A: outer side edge
130: second inserting portion
131: coupling plate
132: inserting piece
132A: locking claw
133A: tapered surface
150B: separating slit

What is claimed is:

1. A combination terminal formed by overlapping a first terminal and a second terminal in a plate thickness direction, wherein:

the first terminal includes a base plate and two inclined walls extending obliquely away from one another in directions intersecting plate surfaces of the base plate from both lateral ends of the base plate and forming an insertion/accommodation space having a trapezoidal shape together with the base plate; and the second terminal includes an inserting piece defining a plate with a plate surface arrangeable to overlap on the base plate by inserting the inserting piece into the insertion/accommodation space, a lock projecting from the plate surface of the inserting piece and to be locked to the base plate by the inserting piece being arranged to overlap on the base portion, and two external force absorbing tapered surfaces laterally extending obliquely from the plate surface of the inserting piece so that a plate thickness of the inserting piece gradually thins along the external force absorbing tapered surfaces, the two external force absorbing tapered surfaces being disposed and configured for coming into surface contact respectively with the two inclined walls when the lock is locked to the base plate.

2. The combination terminal of claim 1, wherein:

the first terminal further includes two first flat plates coupled to the inclined walls and laterally extending;

the second terminal further includes two second flat plates having a plate shape and arrangeable to overlap on the first flat plates in a direction opposite to an overlapping direction of the inserting piece on the base plate;

the base plate is provided with a locking hole communicating with the insertion/accommodation space; and the inserting piece is provided with a locking claw configured to project into the locking hole when the inserting piece is arranged to overlap on the base plate and lockable to the locking hole in a front-rear direction.

3. The combination terminal of claim 2, wherein:

the second terminal further includes the coupling plate, coupling the second flat plates to each other and arranged behind the inclined walls, the inserting piece has a tab shape extending forward from the coupling plate and a separating slit is formed between the external force absorbing tapered portion and the coupling plate.

4. The combination terminal of claim 3, wherein the first terminal includes a wire connecting portion provided on one of the first flat plates and extending laterally farther out than an outer side edge of one of the second flat plates and a rotation stop provided on the other of the first flat plates and extending laterally farther out than an outer side edge of the other of the second flat plates.

* * * * *